US005759706A

United States Patent [19]

Widdemer

[11] Patent Number: 5,759,706

[45] Date of Patent: Jun. 2, 1998

[54] GRAPHITE LUBRICATED LEATHER FOR USE IN GARMENTS FOOTWEAR AND OTHER LEATHER PRODUCTS; A METHOD FOR LUBRICATING LEATHER WITH GRAPHITE AND A GRAPHITE IMPREGNATED LEATHER PRODUCT

[75] Inventor: John D. Widdemer, Gloversville, N.Y.

[73] Assignee: Bali Leathers, Inc., Johnstown, N.Y.

[21] Appl. No.: 771,113

[22] Filed: Dec. 20, 1996

Related U.S. Application Data

[63] Continuation of Ser. No. 106,918, Aug. 16, 1993, abandoned.

[51] Int. Cl.[6] ..... C14C 9/00

[52] U.S. Cl. ..... 428/540; 8/94.2; 2/1; 2/159; 2/161.2

[58] Field of Search ..... 428/540; 8/94.2; 2/159, 161.2, 1

[56] References Cited

U.S. PATENT DOCUMENTS 41,011 12/1863 Lightfoot .
2,287,744 6/1942 Monahan .
3,053,697 9/1962 Zorn et al. ..... 117/142
4,634,118 1/1987 Jenson ..... 272/117

FOREIGN PATENT DOCUMENTS 9320 4/1912 United Kingdom ..... 8/94.2

OTHER PUBLICATIONS

Kedlaya et al. "Metallic Finishing of Leathers with Graphite", Leather Science vol. 20, pp. 216–217, 1973.
Donahue et al. "Welcome to the '90s", Golf Shop Operations, Apr. 1995, pp. 87–88.

*Primary Examiner*—Marion E. McCamish
*Assistant Examiner*—Elizabeth M. Cole
*Attorney, Agent, or Firm*—Aufrichtig Stein & Aufrichtig, P.C.

[57] ABSTRACT

A graphite lubricated leather and a method for producing a graphite lubricated leather is provided. A chrome tanned leather having internal fiber matrix is lubricated by application of a graphite powder suspended in a gluteraldehyde solution which has the effect of penetrating and bonding with the internal fiber matrix of the chrome tanned leather. A highly lubricated dry metallic appearing leather product is provided by the treatment.

10 Claims, 1 Drawing Sheet

GRAPHITE LUBRICATED LEATHER FOR USE IN GARMENTS FOOTWEAR AND OTHER LEATHER PRODUCTS; A METHOD FOR LUBRICATING LEATHER WITH GRAPHITE AND A GRAPHITE IMPREGNATED LEATHER PRODUCT

This is a continuation of application Ser. No. 08/106,918 filed Aug. 16, 1993, abandoned.

BACKGROUND OF THE INVENTION

The invention is generally directed to leather and leather products, internally lubricated by graphite and methods for the production of leather re-tanned with graphite. In particular, the invention is directed to specific methods for the production of leather re-tanned with graphite and leather products such as golf gloves made from such leather.

For many years various attempts have been made to improve the function of leathers by changing the methods of tanning and by putting various additives into the tanning mix during processing. Originally, tanning was accomplished by using bark extracts such as can be obtained from oak, hemlock or avaram trees or leaf extracts such as can be obtained from sumac or bean extracts, such as from the acacia tree.

Mineral tannages have gradually replaced vegetable processes because they produce stronger and more flexible leathers from the raw skins. Of the mineral tannages, the most prominent used today is chromium sulfate. Zirconium and aluminum are other minerals widely used in tanning. Other natural tannages include aldehyde (toxic because it uses formaldehyde) and oil tannage, which is primarily used for "chamois" leather. Of all these tannages it is widely believed that "chrome" tannage produces the strongest leather.

However, after tanning with chromium salts the leather tends to be dry and stiff and unsatisfactory for functional products such as garments, sports gloves and the like. As a result, a subsequent process called "fatliquoring" is usually employed. This process introduces oil weighing between 3% to 10% of the tanned leather into the leather by drumming in a rotating barrel. Usually, these oils are "sulfated" which helps them to disperse within the leather fiber structure and to be more resistant to the effects of acids (such as are found in sweat) than the untreated fish, animal or vegetable oils which are used as the base. Fatliquoring lubricates the chrome tanned leather so that it is usable in products requiring softness, stretchability and resiliency. Synthetic fatliquors are sometimes used and these include synthetic esters, chlorinated hydrocarbons, alpha olefins and amphoteric derivatives. For many purposes the addition of heavy oils to the leather, while providing good lubrication, creates an undesirable "heavy" feel, makes the leather less breathable, thus providing less comfort to the wearer of the product and is gradually lost through flexing or washing, finally leaving the leather dry and stiff before the useful life of the product has expired.

Accordingly, there is a need for an improved leather and leather re-tanning process which provides softness, stretchability and resilience to leathers originally tanned using a chrome or other primary tannage process. There is a particular need to accomplish these desirable characteristics without the weight or oiliness of the fatliquor products and without the undesirable "heavy" feel and limited life span of existing synthetic fatliquors.

SUMMARY OF THE INVENTION

The invention is generally directed to a graphite lubricated leather for use in a leather product in which a chrome tanned leather having an internal fiber matrix has a graphite powder in a gluteraldehyde solution bonded to the chrome tanned leather so that the graphite particles penetrate the internal fiber matrix and are trapped within the internal fiber matrix whereby the trapped graphite particles internally lubricate the leather and provide long lasting softness, stretchability and resilience to the leather.

Another object of the invention is to provide an improved method for producing a graphite lubricated leather including chrome tanning raw natural skins to provide more permanent fiber structure, adding chrome tanned skins to a rotating drum, adding water to the rotating drum, mixing a syntan with a graphite powder to suspend the graphite particle in the syntan, adding a graphite-syntan suspension to the rotating drum, rotating the drum for a first period of time, adding calcium formate to the rotating drum, running the drum for a second period of time and rinsing the treated skins for a third period of time to produce an improved graphite lubricated leather with improved softness, stretchability and resilience.

Still another object of the invention is to provide an improved graphite lubricated leather.

Still another object of the invention is to provide an improved method for producing graphite lubricated leather in which graphite powder is used in a re-tanning process to internally lubricate and create a metallic appearance to the leather.

Still a further object of the invention is to provide an improved leather product which has improved internal lubricating qualities without "heaviness" or oiliness for use in functional garments and gloves.

Yet a further object of the invention is to provide an improved process for lubricating leather for use in garments with a graphite powder which provides a burnished but breathable surface to the leather.

Still another object of the invention is to provide a leather which is permanently lubricated by re-tanning chrome tanned leather with the addition between 1 and 7% (by weight of the chrome tanned leather) graphite powder mixed in a 1–5% solution of gluteraldehyde (5–50% strength) or comparable syntan of choice, mixed with 20–200% (by weight) of water which is drummed for between one half hour and two hours, at which point between 0.25 and 5% calcium formate is added and drumming continues for another period, at which point the graphite has been distributed throughout the skins and is bonding with the leather fibers producing a resultant product which has suppleness caused by the dry lubrication factor of the distributed graphite, a long useful life caused by the reduction of abrasion of the leather fiber matrix during flexing and normal use of the end product, a light "fluffy" feel resulting from the use of the very light weight graphite instead of oils for lubrication and an attractive, distinctive metallic surface appearance which can be varied by the amount of final burnishing of the leather.

Still another object of the invention is to provide improved leather garments for which flexibility, light weight and wearing characteristics are important by use of a graphite lubricant bonded into the fiber of the leather during a re-tanning process.

Still yet a further object of the invention is to provide a improved process for re-tanning chrome tanned leather utilizing a graphite powder to improve the lubrication and appearance of the leather.

Still other objects and advantages of the invention will, in part, be obvious and will, in part, be apparent from the specification.

The invention accordingly comprises the features of construction, combination of elements, arrangement of parts, combinations of steps and procedures, all of which will be exemplified in the constructions and processes hereinafter set forth and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
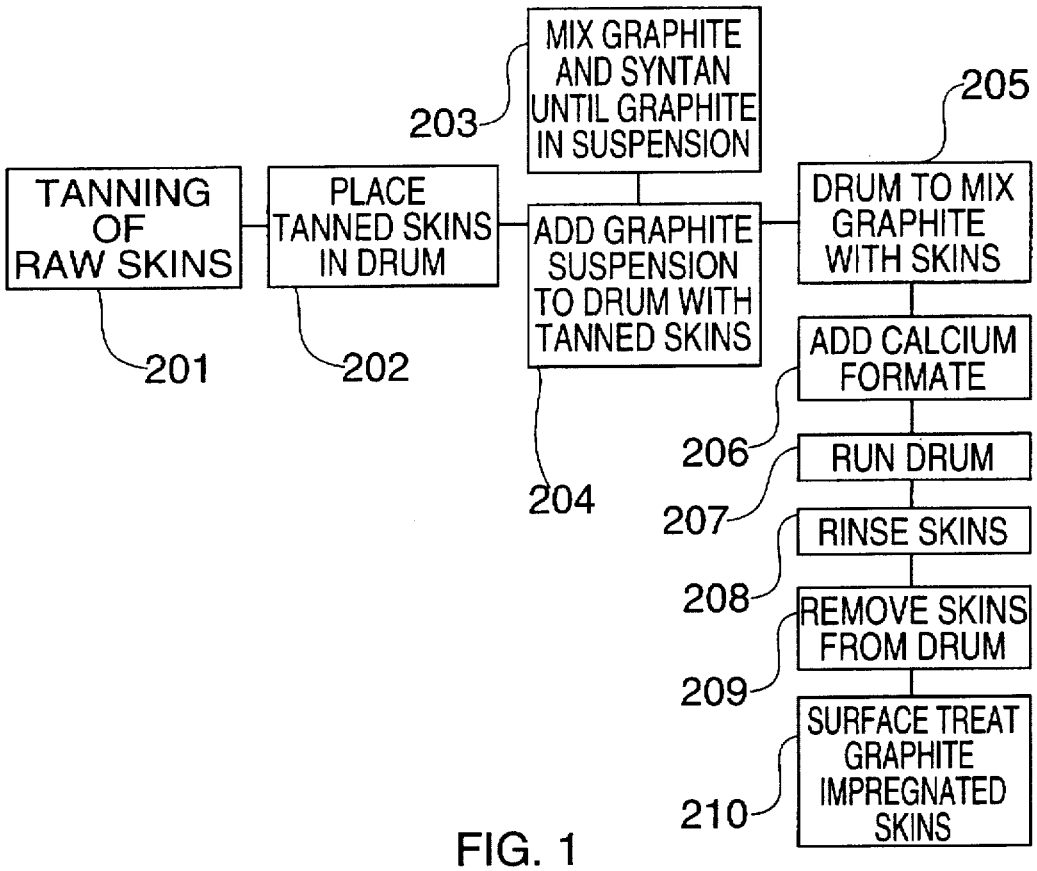
FIG. 1 is a flow chart diagram of a graphite re-tanning process in accordance with a preferred embodiment of the invention.

Leather tanning is an ancient art that has been practiced on a wide variety of materials. The graphite re-tanning process described and claimed herein can be applied to many leather raw materials including sheep skin, goat skin, cowhide, deer skin and calf skin. Depending upon the application of the final leather product different starting materials can be utilized.

The raw material is first brought to a fully chrome tanned stage which imparts permanency to the fiber structure. A typical chrome tanning process described in the *Leather Technician's Handbook* by J. H. Sharphouse, B.S.c Leather Producer's Association, Kings Park Road, Moulton Park, Northampton, U.K. includes a series of fourteen separate steps.

1. First the skins are soaked in drums running at 4 revolutions per minute with 300% water at 27° Celsius and adjusted to a pH of 9.0 with 0.1% non-ionic surfactant. The skins are drummed intermittently for a period of 6 to 12 hours.

2. The skins are then drained.

3. The flesh side of the skins are painted with 15% sodium hydrogen sulphide (33% strength), 50% hydrated lime and 35% water. The skins are allowed to pile overnight and then the wool is removed.

4. Next, 600% water and 12% lime are placed in a vat with agitating paddles run 5 minutes every 4 hours for 24 hours. Then ½% sodium sulphide is added to the vat and the agitating is continued for an additional 12 hours.

5. Next, the flesh is removed from the back side of the skin with a rotary fleshing machine.

6. Next, the skin is washed in soft, running water in a paddle vat for 30 minutes.

7. The skins are delimed in paddle vats containing 500% water at 37 degrees Celsius with 1.5% ammonium chloride where the paddles are run for 60 minutes or until the skins are free of lime.

8. The bating process includes the addition of 1% bacterial bate with the paddles run for 2 to 3 hours.

9. Next the skins are pickled in a drum with the pickling liquor being formed of 200% water at 20 degrees Celsius, 20% salt and 2% sulfuric aced. The drum is run for 60 minutes, with the final pickle liquor strength being a 0.5% solution of sulfuric acid. The drum is then drained and the skins are stored for aging for several days.

10. The Chrome tannage in the drum step includes 100% water, 5% salt, 1% chromic oxide (as 10% of chrome liquor of 11% chromic oxide and 33% basicity, $SO_2$ reduced) and then 1% chromic oxide (as 10% of the above chrome liquor). The skins are then drummed for from 2 to 6 hours in this mixture until penetrated.

11. The skins are then basified. To complete the tannage ½–1% sodium bicarbonate should be added carefully over 4 hours and then a shrinkage temperature test should be taken. At the completion of tannage the pH should be approximately 4.4 and the shrinkage temperature 98 degrees Celsius.

12. The skins are then piled and drained for 24 hours.

13. Then the skins are neutralized thoroughly in the drum with 150% water and 1½% ammonium bicarbonate. The drum is run for 60 minutes to give a pH throughout the skin of 5.5–6.0.

14. Finally, the skins are washed well, at which point the leather is fully chrome tanned and ready for the re-tannage by the graphite process applicant has developed.

The chrome tanning process described above is well known in the art and does not form a portion of applicant's invention. It is merely provided as a representative description of the primary tanning process performed on the raw skins prior to the graphite re-tanning process developed by applicant. Other chrome tanning processes or even other basic mineral tanning processes can be utilized as the preliminary tanning preparatory to the use of the graphite process. Chromium sulfate, zirconium and aluminum mineral primary tannages may also be utilized in accordance with applicant's invention.

Once the leather is fully chrome tanned and ready for the re-tannage by the graphite process, an additional tanning process may be utilized.

Reference is made to FIG. 1 where a flow chart diagram of a process in accordance with the invention for re-tanning leather is depicted. In step 201 raw skins are tanned. They may be tanned using mineral tanning processes such as chrome tanning or other tanning processes which provide durability and strength to the raw skins.

Figure 2:
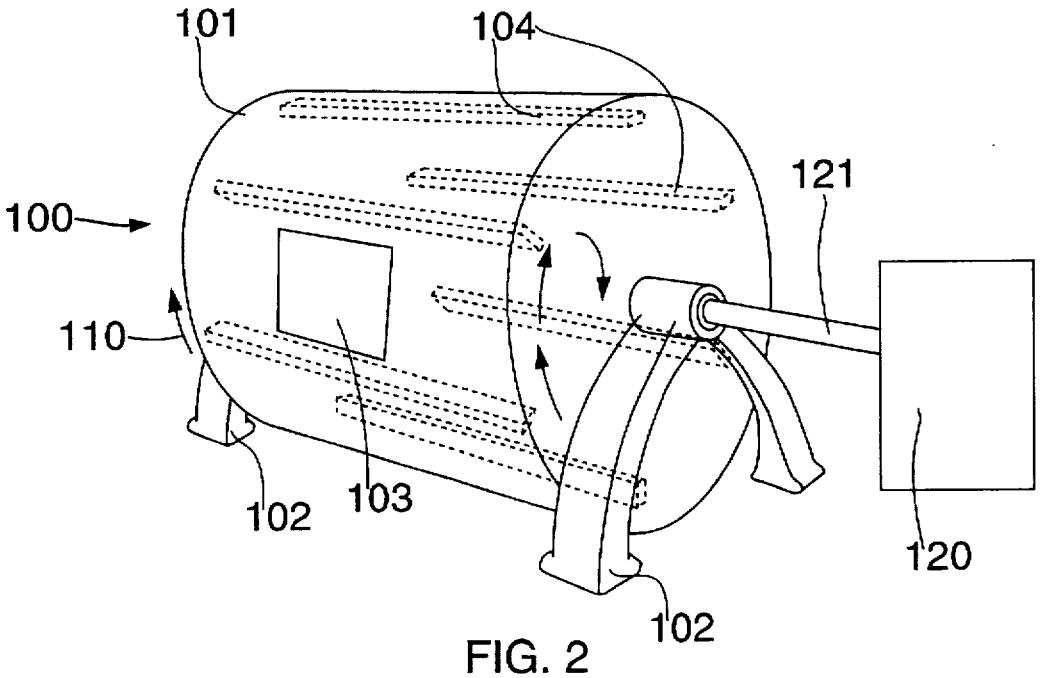
FIG. 2 is a perspective view of a rotating drum for re-tanning leather in accordance with the invention.

In step 202 the skins are placed in a re-tanning drum (100 in FIG. 2). Then, in step 203, graphite powder is mixed with a syntan until the graphite is in suspension. In step 204 the graphite suspension is added to the drum containing the tanned skins.

Then, in step 205, the tanned skins are mixed and agitated in the rotating drum until the graphite suspension penetrates the matrix of the tanned skins. Once this is completed, in step 206 Calcium Formate is added and in step 207 the drum is again rotated to allow good distribution of the Calcium Formate around the skins.

Finally, the skins and drum are rinsed in step 208 and the re-tanned skins are removed from the drum in step 209. At this stage the skins are completely re-tanned with graphite lubricating the leather so that a softness and suppleness of unusual magnitude is produced.

The re-tanned leather has graphite particles at or near the surface of the leather. To give the leather an attractive metallic appearance, in step 210, surface treatment, such as burnishing with a soft wheel, provides a deep gloss and luster to the surface not previously available with leather products.

In a preferred embodiment chrome tanned skins are added to a rotating drum. Reference is made to FIG. 2 wherein a rotating drum, generally indicated as 100, is depicted. Drum 100 includes a wooden drum portion 101, supported on legs 102 for rotation about a horizontal axis as shown by arrow 110. A motor 120 is used with linkage 121 to drive the rotation of drum 101. Motor 120 and linkage 121 are conventional elements. Drum 101 also includes a flap 103 adapted to open when the skins are to be added or removed from drum 101 and to seal tightly when the retanning process is underway. Drum 101 also includes interior baffles 104 used to mix the skins with the various liquids used in the re-tanning process and to prevent skins sticking to each other. The wooden drum is well known in the tanning and retanning arts and can be used for a primary tanning process as well.

In addition to the tanned skins, a mixture of 100% water (of the drained, fully chrome tanned leather weight) at about 50 degrees Celsius, together with a 3% gluteraldehyde solution (25% strength) or other syntan of choice and 5% graphite powder is premixed with the gluteraldehyde solution or other appropriate syntan of choice. The premixing of the gluteraldehyde solution and the graphite powder has the purpose of suspending the graphite powder in a liquid suspension which will carry it into a deep penetration of the fiber matrix of the skins. The rotating drum is run for a period of about 1 hour. Next, 1.0% of calcium formate is added and the drum is run for about another hour. Finally, the drums are rinsed at about 38 degrees Celsius for 15 minutes.

At this point the suspended graphite powder has fully penetrated the fiber matrix of the skins and has bonded with the fibers creating an internal lubrication for the leather.

Some of the graphite particles have remained at or near the surface leather (corium layer) and these graphite particles can impart a handsome metallic appearance to the leather when it is burnished by application of a velvet covered "plush wheel" turning, in a preferred embodiment, at about 300 rpm. This appearance is both distinctive and commercially appealing as a unique look for leather. Other metallic looks for leather have only been achieved by application of a surface paint or a metallic film transfer, neither of which are permanent nor as attractive as the graphite process result.

Other syntans such as formaldehyde, phenols and napthalenes may be utilized instead of the gluteraldehyde solution. In a preferred embodiment, the gluteraldehyde solution utilized in the process may be between 1 and 7%, an even more preferred range between 2 and 5% and even more preferably 3%. The water component can be preferably between about 25% and 400%, between about 20 and 80 degrees Celsius; more preferably between 50% and 200% water, between 40 and 60 degrees Celsius and even more preferably 100% water at 50 degrees Celsius.

Graphite powder can be mixed in different concentrations down to as little as 0.5% depending upon the degree of lubrication required and the physical appearance and color indicated. Preferably, the graphite powder is between 1 and 6%, even more preferably between 2 and 4% and even more preferably at about 3%. The amount of graphite powder utilized varies depending upon the physical characteristics of the skins being re-tanned and the primary tanning process utilized.

It is important not to use too much graphite. If too much graphite is used the internal matrix of the leather is completely filled with the graphite and additional graphite beyond the capabilities of the internal matrix to hold the graphite is deposited upon the leather. The extra graphite then rubs off as the leather comes in contact with other objects and must be washed off by suitable procedure to avoid staining once the leather is made into a garment.

Where a suitable amount of the graphite is utilized, the full benefits of the lubricating capabilities and characteristics of the graphite are achieved without the graphite leaving the leather's internal matrix. Thus, even though the leather exhibits a surface smoothness similar to the feel of the tip of a lead pencil (graphite), the graphite does not rub off the leather and remains within the leather. The times indicated for the drumming of the graphite and additional drumming following the addition of the calcium formate are preferred values and greater or lesser times may be utilized. The following ranges for the drumming of the graphite are preferred: between 30 minutes and 2 hours, more preferably between 45 minutes and 1.5 hours and even more preferably 1 hour. Likewise, the rinse temperature is preferably between 32 degrees and 44 degrees C., more preferably between 35 degrees and 41 degrees C., and even more preferably 38 degrees Celsius. The rinsing process is preferably conducted for about 10 to 20 minutes, more preferably 12 to 18 minutes and even more preferably for about 15 minutes.

In a preferred embodiment the graphite may be synthetically manufactured graphite or naturally formed. The graphite is generally odorless, green, blue, steel gray or black, greasy powder. In the leather matrix the graphite is generally formed as hexagonal lamellae with a metallic sheen. The graphite has a boiling point of 7592 degrees F. (4200 C.) with a melting point of 6606–6687 degrees F. (3650–3697 C). It has a specific gravity of about 2.09–2.25 and a vapor pressure of 0 at 20 degrees Celsius. It is insoluble in water, soluble in liquid iron and is generally insoluble in acids and alkalies. The graphite is an electrical conductor.

Graphite is also utilized in manufacture of golf club shafts and tennis racket shafts taking advantage of its flexibility in a solid crystalline form. This invention does not utilize those characteristics of the graphite, rather, it utilizes the highly slippery nature of graphite. Generally, the hexagonal lamellae slide over each other with extremely low friction and accordingly provide strong dry lubricating characteristics. In accordance with the process disclosed above, the graphite is able to impregnate the entire leather product so that there is a complete internal lubrication which is sustained permanently.

The graphite imbedded leather is particularly suitable for use in sporting equipment and clothing due to the high degree of flexibility and lightness of the leather following the graphite treatment. In particular, golf gloves are particularly suitable for use with the graphite lubricated leather as the graphite treatment provides a very flexible and soft leather which is strong and less likely to catch or rip as often occurs to leather gloves upon an improper grip. With the graphite in the glove, the glove is less likely to be snagged between the wearer's palm and the grip of the glove with an incorrect grip.

The leather is also suitable for use in other leather products such as bicycle gloves and other specialty gloves, shoes, elbow guards, knee guards and other similar bracing materials.

Accordingly, an improved finished leather is provided in which graphite powder is suspended and trapped within the fiber matrix of the skins to create an internal lubrication for the leather.

It will thus be seen that the objects set forth above, among those made apparent in the proceeding description, are efficiently obtained and, since certain changes may be made in the above constructions and processes without departing from the spirit and scope of the invention, it is intended that all matter contained in the above description or shown in the accompanied drawings shall be interpreted as illustrative, and not in the limiting sense.

It will also be understood that the following claims are intended to cover all of the generic and specific features of the invention, herein described and all statements of the scope of the invention which, as a matter of language, might be said to fall therebetween.

What is claimed is:

1. A graphite re-tanned leather for use in a garment, footwear or other leather product, comprising:

a tanned leather having an internal fiber matrix;

a graphite powder of graphite particles, bonded to the tanned leather in a retanning process so that the graphite particles penetrate the internal fiber matrix and are trapped within and bonded to the internal fiber matrix; and the trapped graphite particles in the tanned leather internally lubricate the leather, making the leather softer, whereby the graphite lubricated leather is particularly suitable for use in garments, footwear and other leather products requiring soft and supple leather.

2. The graphite re-tanned leather of claim 1 wherein the graphite powder is suspended in a 1–5 mix with a syntan solution prior to bonding with the tanned leather.

3. The graphite lubricated leather of claim 2 wherein the syntan is gluteraldehyde.

4. A graphite re-tanned leather for use in a garment, footwear or other leather product, comprising:

a tanned leather having an internal fiber matrix; and a graphite powder formed of graphite particles, bonded to the tanned leather in a retanning process by the graphite particles penetration of the internal fiber matrix and the graphite particles being trapped within and bonded to the internal fiber matrix; and whereby the trapped graphite particles internally lubricate the leather making it softer and suppler and more particularly suitable for use in garments, footwear and other leather products requiring soft and supple leather.

5. The graphite re-tanned leather of claim 4 wherein the graphite powder is suspended in a 1–5% mix with the solution prior to bonding with the tanned leather.

6. A graphite re-tanned leather for use in a garment, footwear or other leather product, comprising:

a tanned leather having an internal fiber matrix; and a graphite powder, formed of graphite particles, bonded to the tanned leather in a retanning process by the graphite particles' penetration of the internal fiber matrix and the graphite particles being trapped within and bonded to the internal fiber matrix;

and the trapped graphite particles internally lubricate the leather making it softer and suppler and are particularly suitable for use in garments, footwear and other leather products requiring soft and supple leather.

7. The graphite lubricated leather of claim 6 wherein the outer surface of the tanned leather is buffed after the graphite powder is bonded to the tanned leather to form a smooth exterior surface.

8. A glove comprising:

a tanned leather having an internal fiber matrix;

a graphite powder of graphite particles, bonded to the tanned leather so that the graphite particles penetrate the internal fiber matrix and are trapped within and bonded to the internal fiber matrix; and the trapped graphite particles in the tanned leather internally lubricate the leather, making the leather softer.

9. A garment, comprising:

a tanned leather having an internal fiber matrix;

a graphite powder of graphite particles, bonded to the tanned leather so that the graphite particles penetrate the internal fiber matrix and are trapped within and bonded to the internal fiber matrix; and the trapped graphite particles in the tanned leather internally lubricate the leather, making the leather softer.

10. Footwear, comprising:

a tanned leather having an internal fiber matrix;

a graphite powder of graphite particles, bonded to the tanned leather so that the graphite particles penetrate the internal fiber matrix and are trapped within and bonded to the internal fiber matrix; and the trapped graphite particles in the tanned leather internally lubricate the leather, making the leather softer.

* * * * *